US010976088B2

(12) United States Patent
Ronga et al.

(10) Patent No.: US 10,976,088 B2
(45) Date of Patent: Apr. 13, 2021

(54) APPARATUS FOR INJECTING A FLUID IN A PRESSURIZED AIR CONDITIONING OR REFRIGERATION SYSTEM

(71) Applicant: Errecom S.r.l., Corzano (IT)

(72) Inventors: Luca Ronga, Corzano (IT); Nicola Ronga, Corzano (IT)

( * ) Notice: Subject to any disclaimer, the term of this patent is extended or adjusted under 35 U.S.C. 154(b) by 115 days.

(21) Appl. No.: 16/516,820

(22) Filed: Jul. 19, 2019

(65) Prior Publication Data

US 2019/0338992 A1 Nov. 7, 2019

Related U.S. Application Data

(63) Continuation-in-part of application No. 14/210,489, filed on Mar. 14, 2014, now Pat. No. 10,401,066.

(51) Int. Cl.

| | |
|---|---|
| ***F25B 45/00*** | (2006.01) |
| ***B67D 7/02*** | (2010.01) |
| ***B67D 7/00*** | (2010.01) |

(52) U.S. Cl.

CPC ..... *F25B 45/00* (2013.01); *B67D 7/002* (2013.01); *B67D 7/0294* (2013.01)

(58) Field of Classification Search

CPC ..... F25B 45/00; F25B 2345/001; F25B 2345/006; B67D 7/0294; B67D 7/002

USPC ..... 141/348

See application file for complete search history.

(56) References Cited

U.S. PATENT DOCUMENTS

| | | | | |
|---|---|---|---|---|
| 1,342,678 | A ‡ | 6/1920 | Houghton | F16N 21/04 137/614 |
| 1,366,381 | A ‡ | 1/1921 | Gullborg | F16N 21/04 184/105.2 |
| 1,637,325 | A ‡ | 7/1927 | Jacques | F16N 21/04 141/351 |
| 1,787,439 | A ‡ | 1/1931 | Fesler | F16N 21/04 137/614.04 |
| 2,864,366 | A ‡ | 12/1958 | Miskel | A61M 5/24 604/190 |
| 3,303,663 | A * | 2/1967 | Miller | F25B 45/00 62/149 |
| 3,307,595 | A ‡ | 3/1967 | Friedel | F23Q 2/52 141/293 |
| 3,402,747 | A ‡ | 9/1968 | Tissot-Dupont | F17C 13/04 137/614 |
| 3,459,177 | A ‡ | 8/1969 | Deuschle | A61B 5/15003 141/348 |
| 3,476,507 | A ‡ | 11/1969 | Leeds | A61L 2/20 141/348 |
| 4,046,145 | A ‡ | 9/1977 | Choksi | A61J 1/2096 141/2 |

(Continued)

*Primary Examiner* — Timothy L Maust
*Assistant Examiner* — James R Hakomaki
(74) *Attorney, Agent, or Firm* — Themis Law

(57) ABSTRACT

An apparatus for injecting an additive in a pressurized air conditioning or refrigeration system having a service valve includes a cartridge with a piston, an adapter configured to be connected to the service valve, and a bending unit interposed between the adapter and the cartridge. The bending unit includes a flexible capillary tube having a first end fitting adapted to be connected to the cartridge. The flexible capillary tube has a second end fitting adapted to be connected to the adapter. The flexible capillary tube is adapted to be bent at least at 90° without kinking.

20 Claims, 5 Drawing Sheets

(56) References Cited

U.S. PATENT DOCUMENTS 4,338,793 A ‡ 7/1982 O'Hern, Jr. ..... F25B 45/00 137/231
4,406,314 A ‡ 9/1983 Gomersall ..... B67D 1/04 141/302
4,467,620 A * 8/1984 Bradley ..... F16N 3/06 222/380
5,167,140 A * 12/1992 Cooper ..... G01M 3/20 73/40.7
5,673,722 A ‡ 10/1997 Brass ..... F25B 45/00 116/276
5,826,636 A ‡ 10/1998 Trigiani ..... F16N 37/02 141/38
5,868,224 A ‡ 2/1999 DiCarlo ..... F16L 19/065 141/346
5,967,204 A ‡ 10/1999 Ferris ..... F25B 45/00 141/383
6,050,310 A ‡ 4/2000 Trigiani ..... F16N 37/02 141/18
6,056,162 A ‡ 5/2000 Leighley ..... F16N 29/00 222/156
6,164,348 A ‡ 12/2000 Rodwell ..... G01M 3/20 141/18
6,170,541 B1 ‡ 1/2001 Sanhaji ..... B60H 1/00585 141/67
6,186,197 B1 ‡ 2/2001 Trigiani ..... F16N 37/02 141/38
6,253,810 B1 ‡ 7/2001 Trigiani ..... F16N 37/02 141/38
6,293,319 B1 ‡ 9/2001 Trigiani ..... F16N 37/02 141/38
6,439,274 B1 ‡ 8/2002 DeBoisblanc ..... B60H 1/00858 141/67
6,561,237 B1 ‡ 5/2003 Brass ..... F16L 29/02 141/1
6,591,629 B1 * 7/2003 Galbreath, Jr. ..... F25B 45/00 62/149
6,745,591 B1 ‡ 6/2004 Lin ..... F25B 45/00 62/292
6,807,976 B2 ‡ 10/2004 Knowles ..... F16L 37/30 137/1
6,840,291 B2 ‡ 1/2005 Caizza ..... A61M 5/3234 141/18
6,851,442 B2 * 2/2005 Knowles ..... F16L 37/30 137/1
6,880,587 B1 ‡ 4/2005 Carter ..... B60H 1/00585 141/383
6,889,537 B2 * 5/2005 Anderson ..... G01M 3/042 73/40
2004/0050146 A1 ‡ 3/2004 Anderson ..... G01M 3/042 73/40
2005/0081914 A1 ‡ 4/2005 Kalley ..... F16L 29/02 137/1
2009/0099512 A1 ‡ 4/2009 DiGregorio ..... B01L 3/5085 604/90
2010/0139296 A1 ‡ 6/2010 Eggen ..... B60H 1/00585 62/77
2012/0048957 A1 ‡ 3/2012 Brown ..... F25B 45/00 239/1
2014/0338385 A1 ‡ 11/2014 Ronga ..... B65D 83/207 62/292

* cited by examiner
‡ imported from a related application

APPARATUS FOR INJECTING A FLUID IN A PRESSURIZED AIR CONDITIONING OR REFRIGERATION SYSTEM

FIELD OF THE INVENTION

The present invention relates generally to the field of pressurized fluid systems, and more specifically relates to an apparatus for injecting an amount of additive into a pressurized air conditioning or refrigeration system, for example for detecting and sealing leaks. The additive can be one or a combination of a fluorescent dye, a lubricant, a leak stop, a performance enhancer, an anti-moisture additive, a de-icing additive, an acid neutralizing additive, or an internal refrigerant leak detector.

BACKGROUND OF THE INVENTION

Apparatus for injecting a predetermined amount of a fluorescent dye and/or lubricant into a pressurized system have already been proposed. These apparatus normally comprise a cartridge containing the dye to be injected in the system and having an outlet nozzle, a sealing piston slidable inserted in the cartridge to force the dye out the outlet nozzle, and a hose assembly having an end to be connected to the outlet nozzle and the other end suitable to be connected to a service valve of the pressurized air conditioning or refrigeration system. In one embodiment, known for example from U.S. Pat. No. 6,164,348, the hose assembly comprises a pipe thread to a Luer coupling thread adapter, having one end adapted to be mated with a Luer coupling of the outlet nozzle of cartridge; the other end of the adapter is threaded to a check valve fitting, preventing back flow to the syringe. The check valve fitting is in turn threaded to a hose end fitting connected to one end of a flexible high pressure hose segment. A SCHRADER valve coupling is connected to the other end of the hose segment, adapted to be threadably connected to a SCHRADER valve of the low pressure side of an air conditioning/refrigeration system compressor. A check valve is interposed between the cartridge and the hose assembly.

It is evident that such an arrangement requires the provision and the assembly of a number of components and therefore has a complicated structure, also expensive to manufacture and store for the supplier. This is a great drawback also because the market requires that the apparatus is entirely disposable.

Apparently, the length and volume of the hose is approximately the same of the cartridge. This is because in view of the above construction the hose segment must be able to withstand high pressure for safety reasons. In addition, the presence of many components, and in particular of the bulky hose segment, may cause the formation of air in the hose assembly. The user must pay attention to push out the air from the hose assembly to prevent that bubbles of air are dangerously injected into the system with the dye.

Another disadvantage of this arrangement is that, when the piston has forced all the dye out the cartridge, a large quantity of the dye remains contained in the hose assembly.

Another disadvantage of this arrangement is that it cannot be used in narrow spaces. In fact, in view of the fact that the hose of the hose assembly is a high pressure hose, it has a limited flexibility and is prone to kink if forced beyond this limit.

SUMMARY OF THE INVENTION

It is the object of the present invention to provide an apparatus for injecting an additive in an air conditioning or refrigeration system which is able to overcome the above cited drawbacks of the prior art devices.

A further object is to provide an apparatus for injecting an additive in a pressurized air conditioning or refrigeration system that is simple and easy to use.

A still further object is to provide an apparatus for injecting an additive in a pressurized air conditioning or refrigeration system that is economical in cost to manufacture.

A still further object is to provide an apparatus for injecting an additive in a pressurized air conditioning or refrigeration system that can be used also in narrow spaces.

To the accomplishment of the above and related objects, this invention may be embodied in the form illustrated in the accompanying drawings, attention being called to the fact, however, that the drawings are illustrative only, and that changes may be made in the specific construction illustrated and described within the scope of the appended claims

BRIEF DESCRIPTION OF THE DRAWINGS

Various other objects, features and attendant advantages of the present invention will become more fully appreciated as the same becomes better understood when considered in conjunction with the accompanying drawings, in which like reference characters designate the same or similar parts throughout the several views, and wherein.

DETAILED DESCRIPTION OF THE EMBODIMENTS OF THE INVENTION

Figure 3:
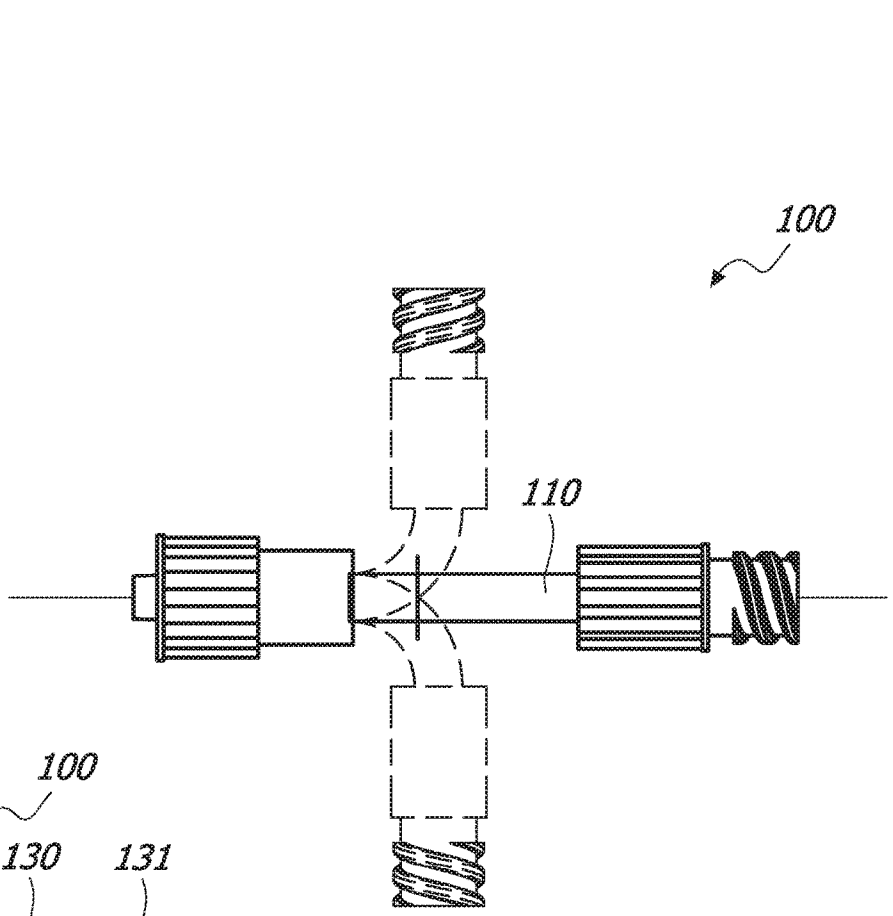
FIG. 3 is a schematic view of the bending unit of FIG. 1, in which the possibility of bending at 90° is shown in dotted lines.
Figure 1:
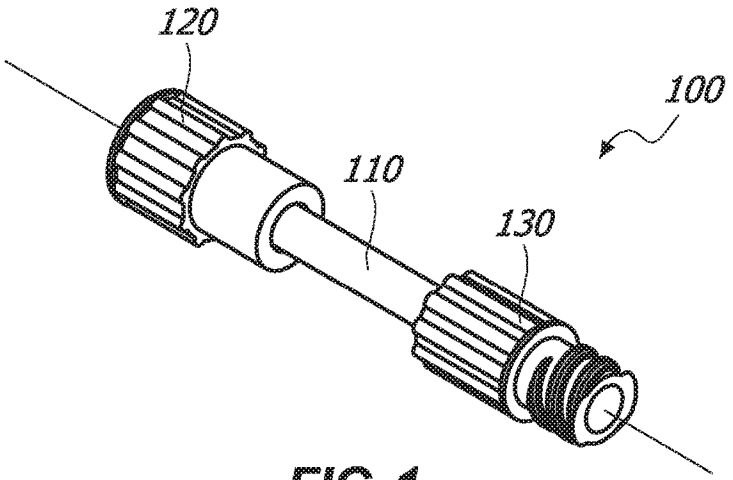
FIG. 1 is an axonometric view of a bending unit according to the invention.
Figure 2:
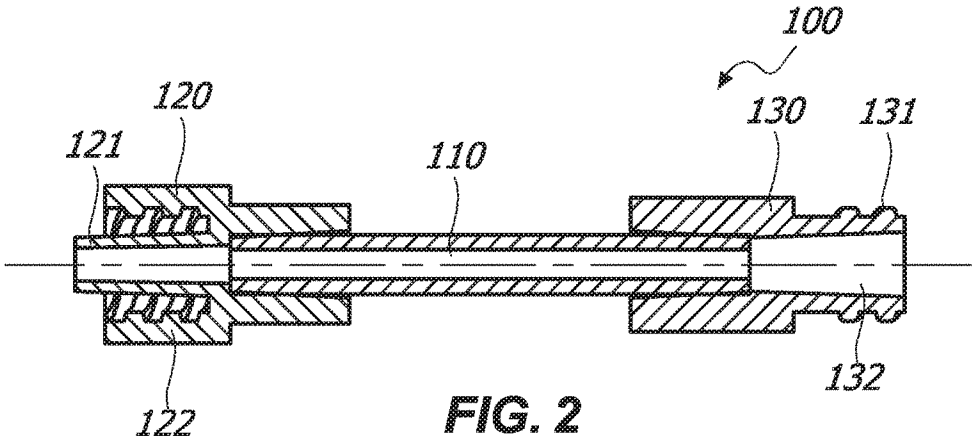
FIG. 2 is an axial section view of the bending unit of FIG. 1.
Figure 4:
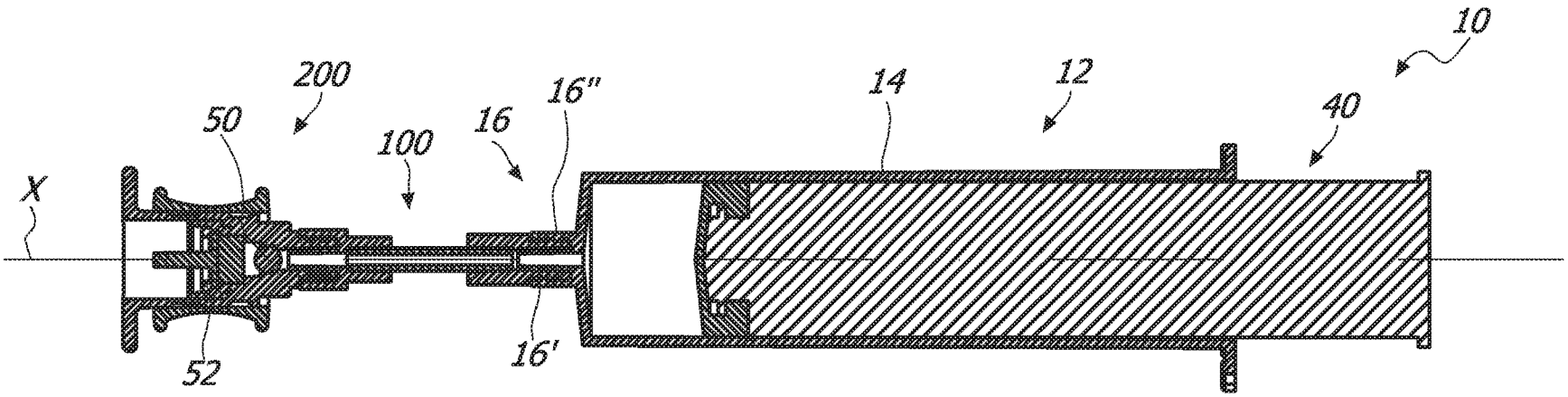
FIG. 4 is an axial section view of a first embodiment of an apparatus according to the invention.
Figure 5:
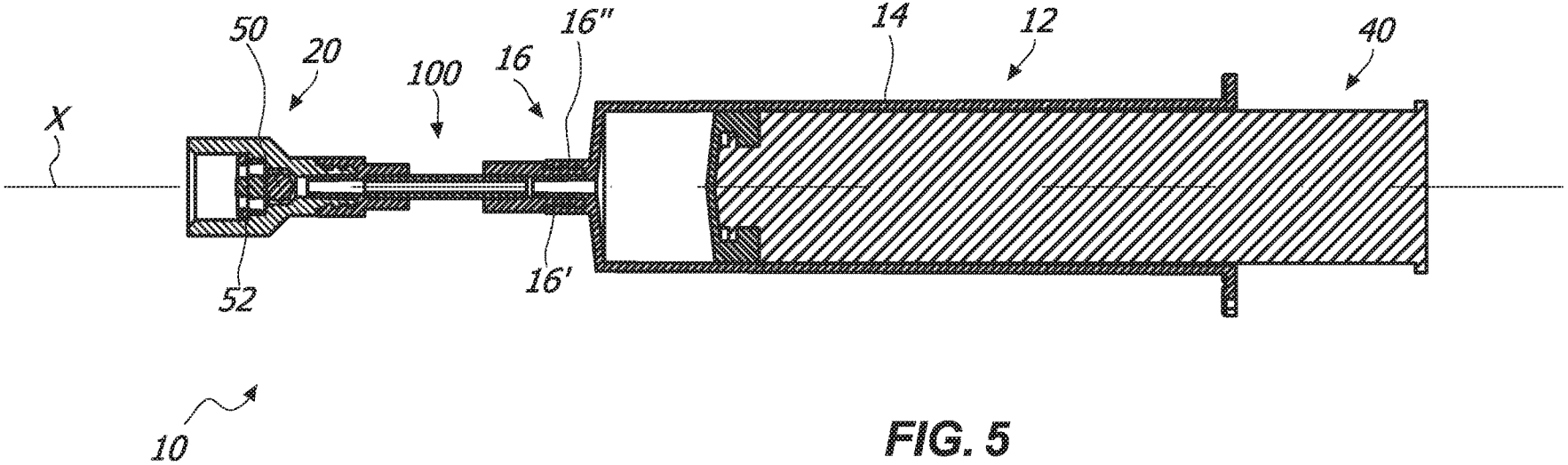
FIG. 5 is an axial section view of an apparatus according to the invention.
Figure 4A:
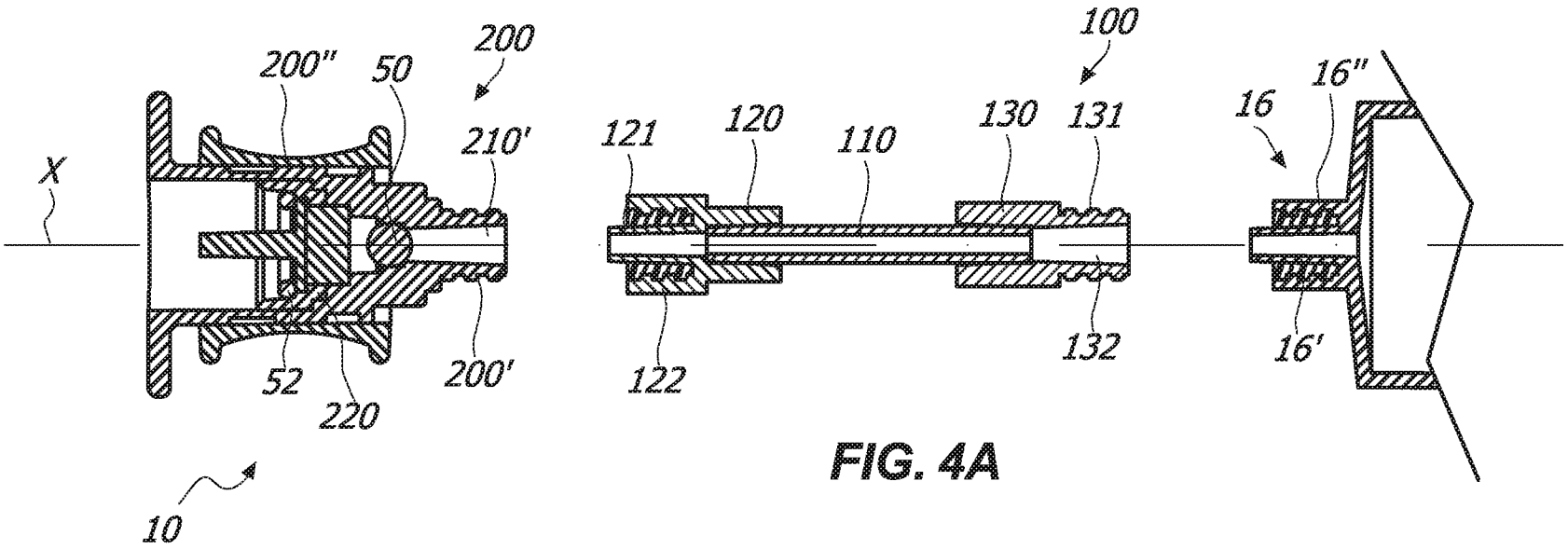
FIG. 4A is an axial section exploded view of the apparatus of FIG. 4.
Figure 5A:
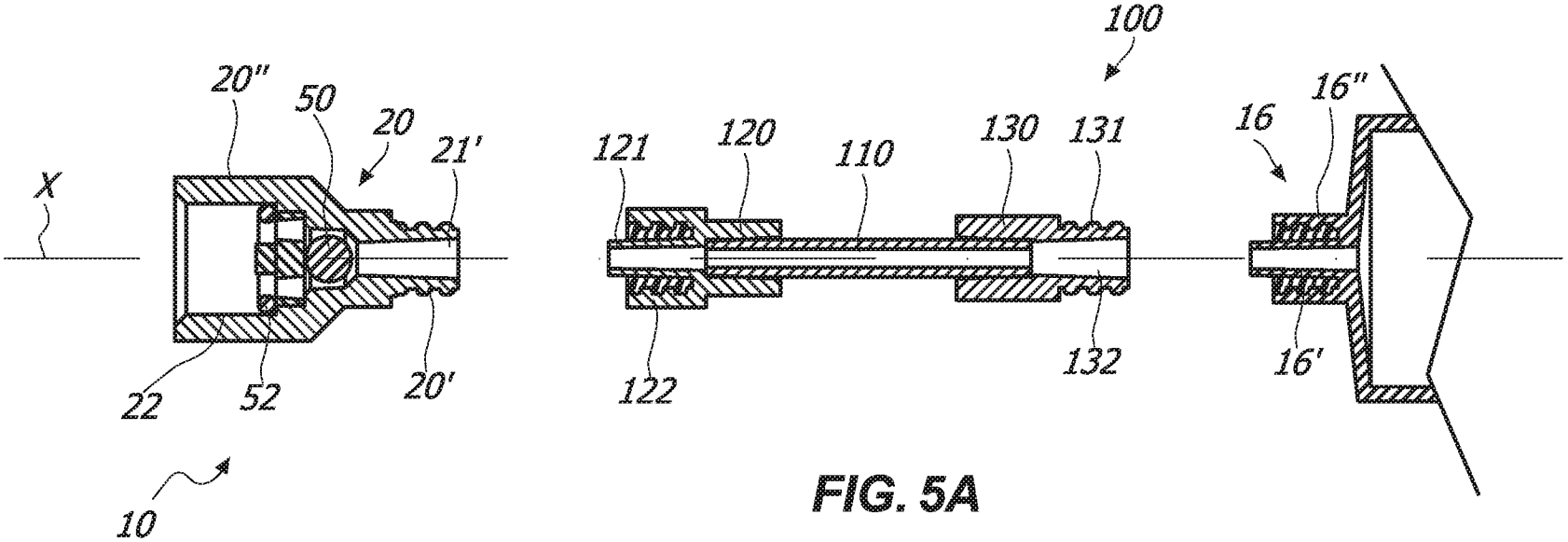
FIG. 5A is an axial section exploded view of the apparatus of FIG. 5.

Turning now descriptively to the drawings, in which similar reference characters denote similar elements throughout the several views, FIGS. 4 and 5 illustrate two different embodiments of an apparatus 10 for injecting an additive, for example a dye for detecting and/or sealing leaks in a pressurized air conditioning or refrigeration system 5; 5'. With regard to the reference numerals used, the following numbering is used throughout the various drawing figures.

The apparatus 10 for injecting an additive in a pressurized air conditioning or refrigeration system comprises a cartridge 12. An adapter 20; 200 is for fluidly coupling the cartridge 12 to a service valve 30; 300 of the pressurized system 5; 5'. Moreover, a bending unit 100 interposed between the cartridge 12 and the adapter 20; 200 allows to inject the additive in the pressurized air conditioning or refrigeration system irrespective of the reciprocal orientation of the cartridge 12 and the adapter 20; 200.

The cartridge 12 defines an axis X and includes a tubular casing 14 for holding an additive to be injected in the pressurized air conditioning or refrigeration system. A threaded nozzle 16 is integral with and extends out from a first end of the tubular casing 14, to engage with one end of the bending unit 100. A sealing piston 40 is inserted within an open second end of the tubular casing 14 and is slidable within the tubular casing 14 to force the additive out the threaded nozzle 16.

The tubular casing 14 can be fabricated out of transparent material and can include a plurality of gradient markings, to aid in accurately dispensing a suitable amount of the additive therefrom.

In one embodiment, the cartridge 12 further includes a threaded cap—not shown—to engage with the threaded nozzle 16 when the cartridge 12 is not in use, so as to prevent leakage of the additive through the threaded nozzle 16.

In one embodiment, the cartridge 12 may be disposable, e.g. in the form of a disposable syringe of the kind commercially available, at low cost, being constructed of a molded plastic.

In one preferred embodiment, the additive will be prepackaged by the supplier of the additive in the cartridge. The cartridge 12 preferably has a volume of 6 ml, which will allow for one sufficient volume to leak test a typical automotive air conditioning system, or, for one injection of dye into a building air conditioning system.

In one preferred embodiment, the threaded nozzle 16 comprises an outlet tube 16' communicating with the interior space of the cartridge. The tube 16' is surrounded with a "Luer" coupling 16" which comprises an internal thread of a form which creates a tight seal with an element advanced thereinto.

The adapter 20; 200 is in the form of a fitting having a fitting body defining an axis Y and having a first end portion 20; 200' and a second end portion 20"; 200" connected to the service valve 30; 300 of the pressurized system 5, 5'. The first end portion 20', 200' has an outer thread and an inner frusto-conical portion 21'; 210'.

In a preferred embodiment, the second end portion 20"; 200" of the fitting body forms a SCHRADER valve coupling to be connected to a SCHRADER valve of the service valve 30; 300 of the pressurized air conditioning or refrigeration system 5; 5'.

In one embodiment (FIGS. 5, 5A, 7A and 7B), the service valve 30 has a SCHRADER valve 32 fitted into an external coupling body 34 having a threaded end portion 36. In this case, the SCHRADER valve coupling of the second end 20" portion of the fitting body has an internal thread 22 to be threadably connected to the threaded end portion 36 of the service valve 30. For example, the SCHRADER valve coupling can have a SAE thread size of ¼ or 5/16 according to the size of the service SCHRADER valve.

In one alternative embodiment (FIGS. 4, 4A, 6A and 6B), the service valve 300 has a SCHRADER valve 32 fitted into an external coupling body 340 having coupling means, for example an annular groove 360, suitable to be engaged by a snap lock fitting 220 made in the second end portion 200" of the fitting body of adapter 200.

In a preferred embodiment, a check valve 50 is housed in the fitting body of the adapter 20; 200, between the first end portion and the second end portion, in order to prevent back flow of the fluid from the air conditioning or refrigeration system to the cartridge and to the bending unit. For example, the check valve is a ball check valve. In this manner, it is possible to connect the apparatus 10 to the pressurized air conditioning or refrigeration system without the danger of bursting of the bending unit.

In a preferred embodiment, the adapter 20; 200 is disposable, e.g. constructed of a molded plastic, for example Nylon.

In a preferred embodiment, the adapter 20; 200 is fabricated out of transparent material and a sealing ring 52 contained in the second end portion and/or the ball of the check valve 50 can have different colors for identifying the different sizes of the second end portion 20"; 200".

Figure 6B:
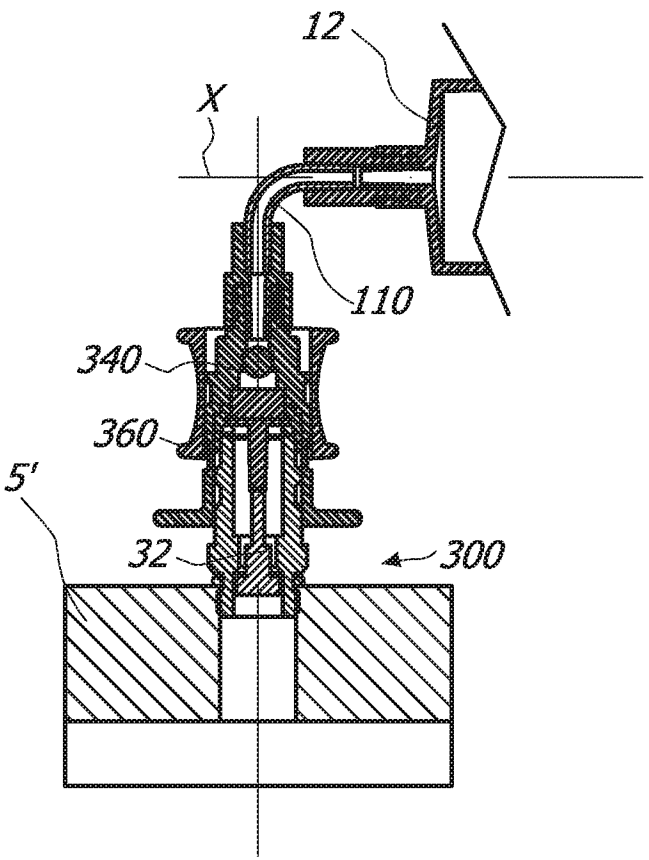
FIG. 6B is an axial section view of the apparatus 10 of FIG. with a flexible capillary tube in bent state at 90°, i.e. when axes X and Y are perpendicular to each other.
Figure 6A:
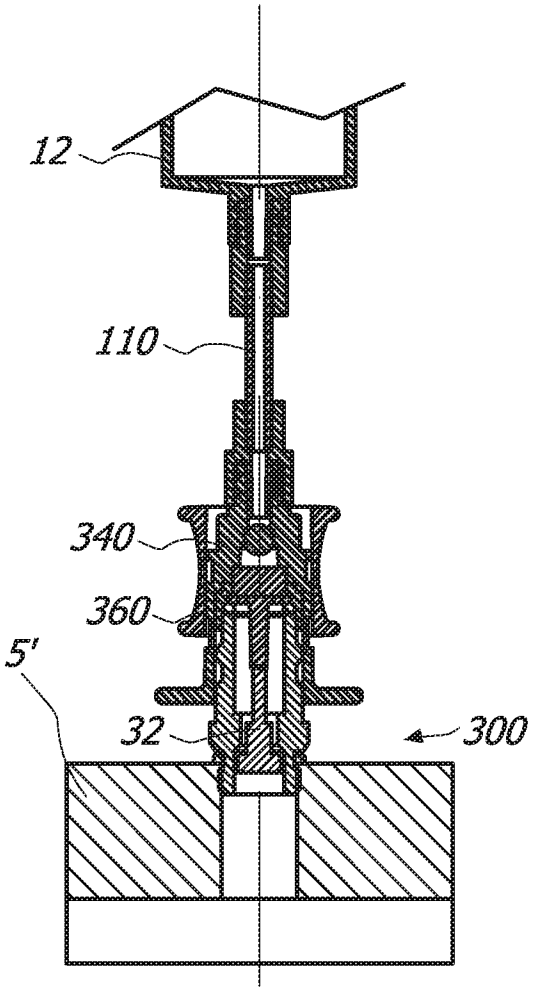
FIG. 6A is an axial section view of the apparatus of FIG. 4 with a flexible capillary tube in unbent state, i.e. when axes X and Y are coincident to each other.
Figure 7B:
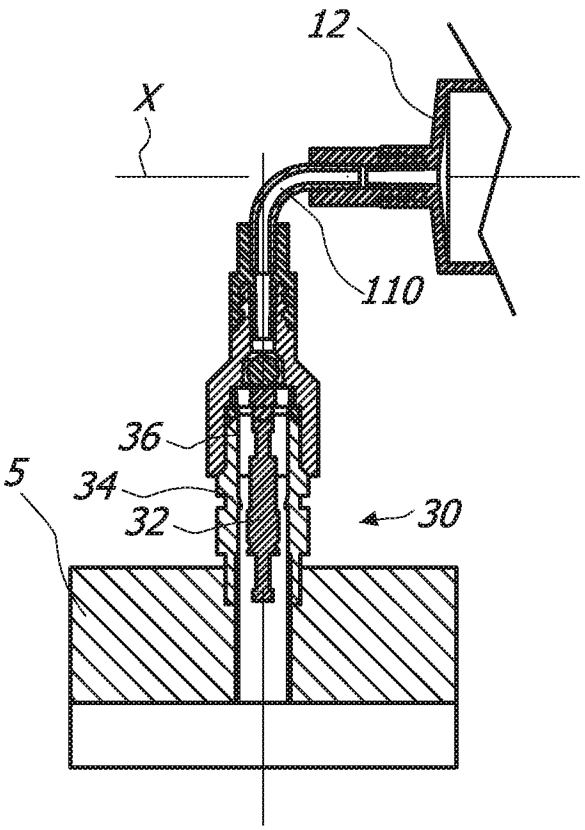
FIG. 7B is an axial section view of the apparatus 10 of FIG. 5 when the flexible capillary tube in bent state at 90°, i.e. when axes X and Y are perpendicular to each other.
Figure 7A:
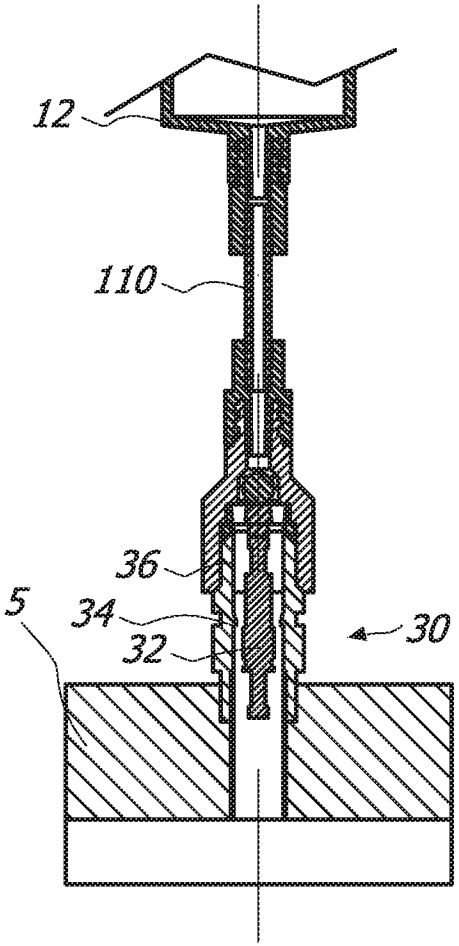
FIG. 7A is an axial section view of the apparatus 10 of FIG. 5 with a flexible capillary tube in unbent state, i.e. when axes X and Y are coincident to each other.

The bending unit 100 consists of a central flexible capillary tube 110 and two end fittings 120, 130. In order to allow to inject the additive in the pressurized air conditioning or refrigeration system irrespective of the reciprocal orientation of the cartridge 12 and the adapter 20; 200, the flexible capillary tube 110 is adapted to pass from an unbent state in which axes X and Y are coincident to each other (FIGS. 6A and 7A) to a bent state in which axes X and Y are transversal to each other, e.g, perpendicular to each other (FIGS. 6B and 7B).

To this end, the flexible capillary tube 110 must be sufficiently flexible without incurring kinking. Suitably, the flexible capillary tube 110 is adapted to be bent at least at 90° without kinking. Advantageously, the flexible capillary tube 110 is made of an elastomer, e.g. polyurethane, and has a Shore A hardness of at least 80, e.g. 95.

Suitably, the flexible capillary tube 110 has a very low internal volume. For example, the flexible capillary tube 110 has a length of 35 mm, an internal diameter of 2 mm and an outer diameter of 4 mm, i.e. a wall thickness of 1 mm.

In a preferred embodiment, the flexible capillary tube 110 is made of a transparent material, in order to allow visual inspection of the additive content.

The fittings 120, 130 are monolithically fixed to the flexible capillary tube 110 to form a unitary piece. In a preferred embodiment, the whole bending unit 100 is disposable. For example, the fittings are constructed of a molded plastic, e.g. Nylon.

The fitting 130 has an outer thread 131 to be connected to the internal thread of the Luer coupling 16" of the threaded nozzle 16 of the cartridge 12 and a frusto-conical inner portion 132 configured to receive the frusto-conical outlet tube 16' of the nozzle 16 of the cartridge 12.

The fitting 120 has a frusto-conical outlet tube 121 surrounded with a "Luer" coupling 122 which comprises an internal thread. The frusto-conical outlet tube 121 is designed to be received by the inner frusto-conical portion 21'; 210' of the adapter 20; 200. The internal thread of the "Luer" coupling 122 is designed to be connected to the outer thread of the first end portion 20', 200' of the adapter 20; 200.

Advantageously, the bending unit has a maximum additive content of less than 0.2 ml, e.g. of 0.160 ml. In this manner, All the amount of additive to be charged in the air conditioning or refrigeration system is really injected therein, since no additive can remain in any intermediate part.

Another advantage of the apparatus 10 is that it is entirely disposable.

It will be understood that each of the elements described above, or two or more together may also find a useful application in other types of arrangement differing from the type describe above.

While certain novel features of this invention have been shown and described are pointed out in the annexed claims, it is not intended to be limited to the details above, since it will be understood that various omissions, modifications, substitutions and changes in the forms and details of the device illustrated and in its operation can be made by those skilled in the art without departing in any way from the spirit of the present invention.

The invention claimed is:

1. An apparatus for injecting an additive in a pressurized air conditioning or refrigeration system having a service valve, comprising:

a cartridge having two ends, the two ends comprising a first open end adapted to connect to the pressurized air conditioning or refrigeration system to be charged and a second open end, wherein the first open end comprises a threaded nozzle, and wherein the threaded nozzle comprises a first frusto-conical outlet tube communicating with an interior space of the cartridge and configured to be surrounded with a first Luer coupling having an internal thread;

a piston sealably disposed within the second open end of the cartridge;

an adapter to fluidly connect in a sealable and releasable manner the cartridge to the service valve of the pressurized air conditioning or refrigeration system; and a bending unit interposed between the adapter and the cartridge, wherein the bending unit includes a flexible capillary tube having a first end fitting with an outer thread configured to be connected to the internal thread of the first Luer coupling and a frusto-conical inner portion configured to receive the first frusto-conical outlet tube of the nozzle of the cartridge, the flexible capillary tube having a second end fitting with a second frusto-conical outlet tube communicating with an interior space of the flexible capillary tube and configured to be surrounded with a second Luer coupling having a second internal thread, wherein the flexible capillary tube is adapted to be bent at least at 90° without kinking, wherein the adapter is configured as a fitting having a fitting body that has a first end portion with an outer thread configured to be connected to the second internal thread of the second Luer coupling and a second end portion configured to be connected to the service valve of the pressurized air conditioning or refrigeration system, the first end portion further having a frusto-conical inner portion configured to receive the second frusto-conical outlet tube of the bending unit, wherein the second end portion of the fitting body forms a SCHRADER valve coupling adapted to engage the service valve of the pressurized air conditioning or refrigeration system, and wherein a check valve is housed in the fitting body of the adapter, between the first end portion and the second end portion, in order to prevent back flow of fluid from the pressurized air conditioning or refrigeration system to the flexible capillary tube and the cartridge.

2. The apparatus according to claim 1, wherein the cartridge defines a first axis, the fitting body defining a second axis, wherein, when the flexible capillary tube is in an unbent state, the first and the second axis are coincident with each other, and wherein, when the flexible capillary tube is in a bent state, the first and the second axis are transversal to each other.

3. The apparatus according to claim 1, wherein the flexible capillary tube is made from an elastomer.

4. The apparatus according to claim 1, wherein the flexible capillary tube has a Shore A hardness of at least 80.

5. The apparatus according to claim 1, wherein the bending unit has a maximum additive content of less than 0.2 ml.

6. The apparatus according to claim 1, wherein the bending unit, the adapter and the cartridge are constructed to be disposable.

7. The apparatus according to claim 1, wherein the adapter and the flexible capillary tube are made from a transparent material.

8. The apparatus according to claim 1, wherein the check valve is a ball check valve.

9. The apparatus according to claim 1, wherein the adapter houses a sealing ring disposed next to the check valve, the sealing ring having a color that identifies a predetermined size of the second portion.

10. The apparatus according to claim 1, wherein the apparatus is configured to be connected to the service valve of the air conditioning or refrigeration system while the air conditioning or refrigeration system is pressurized and the piston is displaceable so as to force the additive out of the cartridge against a pressure provided by the air conditioning or refrigeration system.

11. The apparatus according to claim 1, wherein the additive is one or more of a fluorescent dye, a lubricant, a leak stop, a performance enhancer, an anti-moisture additive, a de-icing additive, an acid neutralizing additive, or an internal refrigerant leak detector.

12. The apparatus according to claim 1, wherein the cartridge contains a predetermined amount of the additive, the additive being contained in the cartridge at a pressure that is substantially the same as ambient pressure.

13. The apparatus according to claim 1, wherein the SCHRADER valve coupling has an internal thread configured to be threadably connected to a threaded end portion of the service valve of the pressurized air conditioning or refrigeration system.

14. The apparatus according to claim 1, wherein the SCHRADER valve coupling has a snap lock fitting configured to be snap-fittingly connected to an end portion of the service valve of the pressurized air conditioning or refrigeration system.

15. A method for injecting an additive in a pressurized air conditioning or refrigeration system, comprising:

fluidly connecting in a sealable and releasable manner an adapter of an additive-injecting apparatus to a service valve of a pressurized air conditioning or refrigeration system to inject an additive into the air conditioning or refrigeration system while the air conditioning or refrigeration system is pressurized, wherein the apparatus comprises the adapter, a cartridge, and a bending unit interposed between the adapter and the cartridge, wherein the cartridge has two ends, the two ends comprising a first open end which adapted to connect to the pressurized air conditioning or refrigeration system being charged and a second open end, wherein the first open end comprises a threaded nozzle, wherein the threaded nozzle comprises a first frusto-conical outlet tube communicating with an interior space of the cartridge and surrounded with a first Luer coupling having an internal thread, wherein the cartridge comprises a piston sealably disposed within the second open end, wherein the bending unit includes a flexible capillary tube having a first end fitting with an outer thread configured to be connected to the internal thread of the first Luer coupling and a frusto-conical inner portion configured to receive the first frusto-conical outlet tube of the nozzle of the cartridge, the flexible capillary tube having a second end fitting with a second frusto-conical outlet tube communicating with an interior space of the flexible capillary tube and surrounded with a second Luer coupling having a second internal thread, wherein the flexible capillary tube is adapted to be bent at least at 90° without kinking, wherein the adapter is configured as a fitting having a fitting body that has a first end portion with an outer thread configured to be connected to the second internal thread of the second Luer coupling and a second end portion configured to be connected to the service valve of the pressurized air conditioning or refrigeration system, the first end portion further having a frusto-conical inner portion configured to receive the second frusto-conical outlet tube of the bending unit, wherein the second end portion of the fitting body forms a SCHRADER valve coupling to engage the service valve of the pressurized air conditioning or refrigeration system, and wherein a check valve is housed in the fitting body of the adapter, between the first end portion and the second end portion, in order to prevent back flow of fluid from the pressurized air conditioning or refrigeration system to the flexible capillary tube and the cartridge.

16. A disposable bending unit adapted to be interposed between an adapter and a cartridge to form an apparatus for injecting an additive in a pressurized air conditioning or refrigeration system having a service valve, wherein the cartridge has two ends, the two ends comprising a first open end which is configured to connect to the pressurized air conditioning or refrigeration system being charged and a second open end, wherein the first open end comprises a threaded nozzle, wherein the threaded nozzle comprises a first frusto-conical outlet tube communicating with an interior space of the cartridge and configured to be surrounded with a first Luer coupling having an internal thread, wherein the cartridge comprises a piston sealably disposed with the second open end;

wherein the adapter is adapted to fluidically connect in a sealable and releasable manner the cartridge to the service valve of the pressurized air conditioning or refrigeration system, wherein the bending unit comprises a flexible capillary tube having a first end fitting with an outer thread configured to be connected to the internal thread of the first Luer coupling and a frusto-conical inner portion configured to receive the first frusto-conical outlet tube of the nozzle of the cartridge, the flexible capillary tube having a second end fitting with a second frusto-conical outlet tube communicating with an interior space of the flexible capillary tube and configured to be surrounded with a second Luer coupling which comprises a second internal thread, wherein the flexible capillary tube is adapted to be bent at least at 90° without kinking, wherein the adapter is configured as a fitting having a fitting body that has a first end portion with an outer thread configured to be connected to the second internal thread of the second Luer coupling and a second end portion configured to be connected to the service valve of the pressurized air conditioning or refrigeration system, the first end portion further having a frusto-conical inner portion configured to receive the second frusto-conical outlet tube of the bending unit, wherein the second end portion of the fitting body forms a SCHRADER valve coupling configured to engage the service valve of the pressurized air conditioning or refrigeration system, and wherein a check valve is housed in the fitting body of the adapter, between the first end portion and the second end portion, in order to prevent back flow of fluid from the pressurized air conditioning or refrigeration system to the flexible capillary tube and the cartridge.

17. The bending unit according to claim 16, wherein, when the flexible capillary tube is in an unbent state, the first end portion and the second end portion of the adapter, the flexible capillary tube and the threaded nozzle of the cartridge are coaxial to each other.

18. The bending unit according to claim 16, wherein the flexible capillary tube is made from an elastomer.

19. The bending unit according to claim 16, wherein the flexible capillary tube has a Shore A hardness of at least 80.

20. The bending unit according to claim 16, wherein the bending unit has a maximum additive content of less than 0.2 ml.

* * * * *